US007227967B2

(12) United States Patent
Naniki

(10) Patent No.: US 7,227,967 B2
(45) Date of Patent: Jun. 5, 2007

(54) PIEZOELECTRIC TRANSDUCER ADAPTED TO BRIDGE OF STRINGED INSTRUMENT

(75) Inventor: Akio Naniki, Hamamatsu (JP)

(73) Assignee: Yamaha Corporation (JP)

( * ) Notice: Subject to any disclaimer, the term of this patent is extended or adjusted under 35 U.S.C. 154(b) by 675 days.

(21) Appl. No.: 10/714,976

(22) Filed: Nov. 18, 2003

(65) Prior Publication Data

US 2004/0105560 A1 Jun. 3, 2004

(30) Foreign Application Priority Data

Nov. 28, 2002 (JP) ..... 2002-346195

(51) Int. Cl.
*H04R 25/00* (2006.01)
*G10H 3/18* (2006.01)

(52) U.S. Cl. ..... 381/190; 381/173; 84/731

(58) Field of Classification Search ..... 84/730, 84/731, 732; 381/190, 173, 114; 310/311, 310/367, 368, 340, 342, 344, 365–371
See application file for complete search history.

(56) References Cited

U.S. PATENT DOCUMENTS 5,463,185 A * 10/1995 Fishman ..... 84/731
5,670,733 A 9/1997 Fishman

FOREIGN PATENT DOCUMENTS

| | | |
|---|---|---|
| DE | 3536921 C2 | 2/1989 |
| DE | 9012418.9 | 11/1990 |
| JP | 60-145499 | 9/1895 |
| JP | 3-174591 | 7/1991 |
| JP | 5-94896 | 12/1993 |
| JP | 7-160265 | 6/1995 |
| JP | 2000-267668 | 9/2000 |
| JP | 2000-515258 | 11/2000 |

OTHER PUBLICATIONS

German Office Action isssued Oct. 6, 2004 (w/ English translation).
Japanese Office Action issued Feb. 28, 2006 (w/ English translation of relevant portions).

* cited by examiner

*Primary Examiner*—Curtis Kuntz
*Assistant Examiner*—Tuan Duc Nguyen
(74) *Attorney, Agent, or Firm*—Dickstein, Shapiro, LLP.

(57) ABSTRACT

A piezoelectric transducer, adapted to a bridge of a stringed instrument such as a sound mute guitar, comprises a piezoelectric element roughly having an elongated rectangular shape, a pair of electrodes respectively attached to the upper and lower surfaces of the piezoelectric element, and insulation sheets for insulating the electrodes, all of which are covered with a conductive shield (e.g., a polymeric piezoelectric film), wherein a thin metal plate is adhered to at least the exterior of the upper surface of the conductive shield and is composed of a prescribed metal, which is selected from among copper, gold, and platinum, or a prescribed alloy mainly composed of one of these metals. The thin metal plate is adhered to the conductive shield by use of unhardened adhesive with a coating thickness of 10 μm or less.

7 Claims, 8 Drawing Sheets

PIEZOELECTRIC TRANSDUCER ADAPTED TO BRIDGE OF STRINGED INSTRUMENT

BACKGROUND OF THE INVENTION

1. Field of the Invention

This invention generally relates to stringed instruments such as guitars, and in particular, to piezoelectric transducers that are incorporated into bridges to produce electric signals upon detection of vibrations of strings.

This application claims priority on Japanese Patent Application No. 2002-346195, the content of which is incorporated herein by reference.

2. Description of the Related Art

Recently, in the fields of electronic musical instruments, so-called 'sound mute type' musical instruments are becoming widespread in the market because they allow users (or players) to play or practice musical instruments in restricted environments that do not allow generation of musical tones at high tone volumes.

FIG. 9 shows an example of the constitution of a guitar having sound mute function (simply referred to as a sound mute guitar). That is, a sound mute guitar 100 is constituted by nylon strings 110, a bridge 120 for supporting the nylon strings 110, a center body 130 for supporting the bridge 120, and a pair of frames 140 that form parts of the whole body and are arranged to the left and the right of the center body 130. The sound mute guitar 100 shown in FIG. 9 does not comprise a resonating body, which is normally provided for a general-use acoustic guitar. For this reason, even when the user (or player) plucks the nylon strings 110, the sound mute guitar 100 produces musical tones at very small tone volumes compared with normal tone volumes produced by playing a general-use acoustic guitar. In addition, the sound mute guitar 100 comprises a piezoelectric transducer that is arranged inside of the bridge 120 so as to produce electric signals upon detection of vibrations of the nylon strings 110. Furthermore, the sound mute guitar 100 comprises electric circuitry that is arranged inside of the center body 130 so as to amplify electric signals output from the piezoelectric transducer, so that amplified electric signals are supplied to a headphone terminal (or a headphone jack, not shown). Thus, even though the sound mute guitar 100 actually produces musical tones at very small tone volumes in the surroundings, the user of the sound mute guitar 100 can use a headphone set 150 to listen to musical tones with live-audio presence that the user may experience actually playing an acoustic guitar.

FIG. 10 is a cross sectional view taken along line A—A in FIG. 9 in proximity to the bridge 120 of the sound mute guitar 100. FIG. 11 is an exploded perspective view showing parts of the bridge 120 that are isolated from each other in illustration.

As shown in FIGS. 10 and 11, the bridge 120 is constituted by a support member 111 for supporting the strings 110, a bridge base 112 having an elongated hollow 112*a* for fixing the support member 111 therein, and a piezoelectric transducer 113 that is arranged between the support member 111 and the bridge base 112.

The piezoelectric transducer 113 is formed in a thin elongated rectangular shape that substantially matches the bottom shape of the elongated hollow 112*a* of the bridge base 112. Reasons why the piezoelectric transducer 113 is roughly formed in an elongated rectangular shape is to uniformly detect vibrations of all the strings 110.

FIG. 12 shows a cross-sectional constitution of the piezoelectric transducer 113, which is constituted by various layers arranged between an upper surface (facing the support member 111) and a lower surface (facing the bottom of the elongated hollow 112*a* of the bridge base 112). That is, the piezoelectric transducer 113 is constituted by a polymeric piezoelectric film 113*a* composed of polyvinylidene fluoride (PVDF), a pair of electrodes 113*b* respectively adhered to the upper surface and the lower surface of the polymeric piezoelectric film 113*a*, and a pair of insulation sheets 113*c* composed of vinyl chloride and the like, all of which are completely covered with a conductive shield (or a shield layer) 113*d*. The insulation sheets 113*c* are arranged to insulate the electrodes 113*b* from the conductive shield 113*d*. Herein, the conductive shield 113*d* is composed of a prescribed material such as aluminum and copper, details of which are disclosed in Japanese Patent Application Publication No. Hei 7-160265 (in particular, page 3 and FIG. 2), for example.

As described above, it is necessary to cover the polymeric piezoelectric film 113*a* and its related layers with the conductive shield 113*d* because the polymeric piezoelectric film 113*a* composed of PVDF and the like normally has a high impedance and may easily pick up external noise such as hum noise (or humming noise). That is, in order to reduce the influence of external noise, the polymeric piezoelectric film 113*a* is covered with the conductive shield 113*d*.

The most important point that the user (or player) may regard as an important factor in playing the sound mute guitar 100 is the tone color of the sound mute guitar 100 that can be heard via the headphone set 150 and the like. It is a present problem that the tone color of the sound mute guitar 100 may be greatly influenced by the piezoelectric transducer 113. The manufacturer which produces the sound mute guitar 100 may actualize a high-quality tone color by installing a high-performance piezoelectric transducer having a desired characteristic in the sound mute guitar 100. However, such a piezoelectric transducer is very expensive and reduces productivity. For this reason, the manufacturer of the sound mute guitar 100 must use a relatively inexpensive piezoelectric transducer, which can be produced at a relatively high productivity, by sacrificing important factors such as tone color of the sound mute guitar 100.

SUMMARY OF THE INVENTION

It is an object of the invention to provide a piezoelectric transducer adapted to a bridge of a stringed instrument, wherein the piezoelectric transducer is improved in its characteristics even though it is produced at a relatively high productivity and at a relatively low cost.

A piezoelectric transducer of this invention comprises a piezoelectric element roughly having an elongated rectangular shape, a pair of electrodes respectively attached to the upper and lower surfaces of the piezoelectric element, and insulation sheets for insulating the electrodes, all of which are covered with a conductive shield (e.g., a polymeric piezoelectric film), wherein a thin metal plate is adhered to at least the exterior of the upper surface of the conductive shield and is composed of a prescribed metal, which is selected from among copper, gold, and platinum, or a prescribed alloy mainly composed of one of copper, gold, and platinum. Herein, the thin metal plate is adhered to the conductive shield by use of un-hardened adhesive with a coating thickness of 10 μm (micrometer) or less.

In the above, it is possible to modify the piezoelectric transducer in such a way that a thin metal plate composed of copper is adhered to the exterior of the upper surface of the conductive shield, and a secondary thin metal plate composed of gold or platinum is adhered to the exterior of the lower surface of the conductive shield.

In addition, the bridge of a stringed instrument comprises a support member for supporting strings, and a bridge base having an elongated hollow for vertically supporting the support member via the piezoelectric transducer.

Therefore, a stringed instrument such as a sound mute guitar can be constituted using the aforementioned piezoelectric transducer that is adapted to the aforementioned bridge, wherein the piezoelectric transducer produces electric signals upon detection of vibrations of strings so as to contribute to the generation of musical tones which are improved in sound quality particularly in a higher frequency range.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
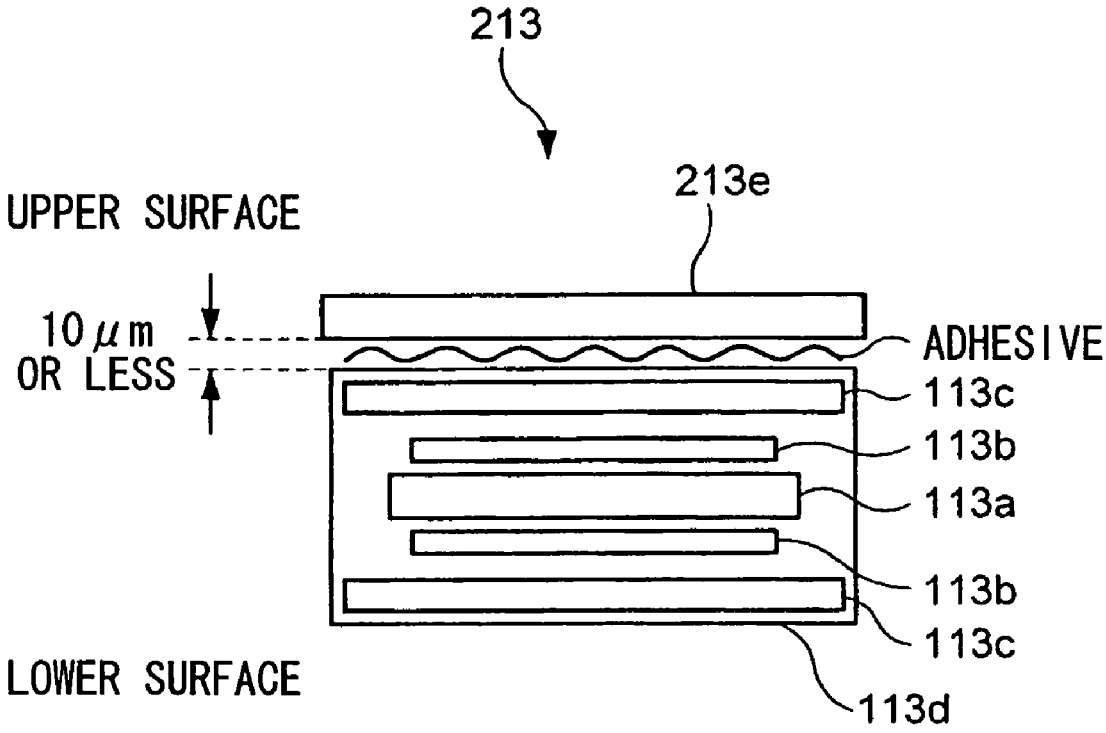
FIG. 1 is a cross sectional view diagrammatically showing the constitution of a piezoelectric transducer adapted to a bridge of a sound mute guitar in accordance with a preferred embodiment of the invention.
Figure 9:
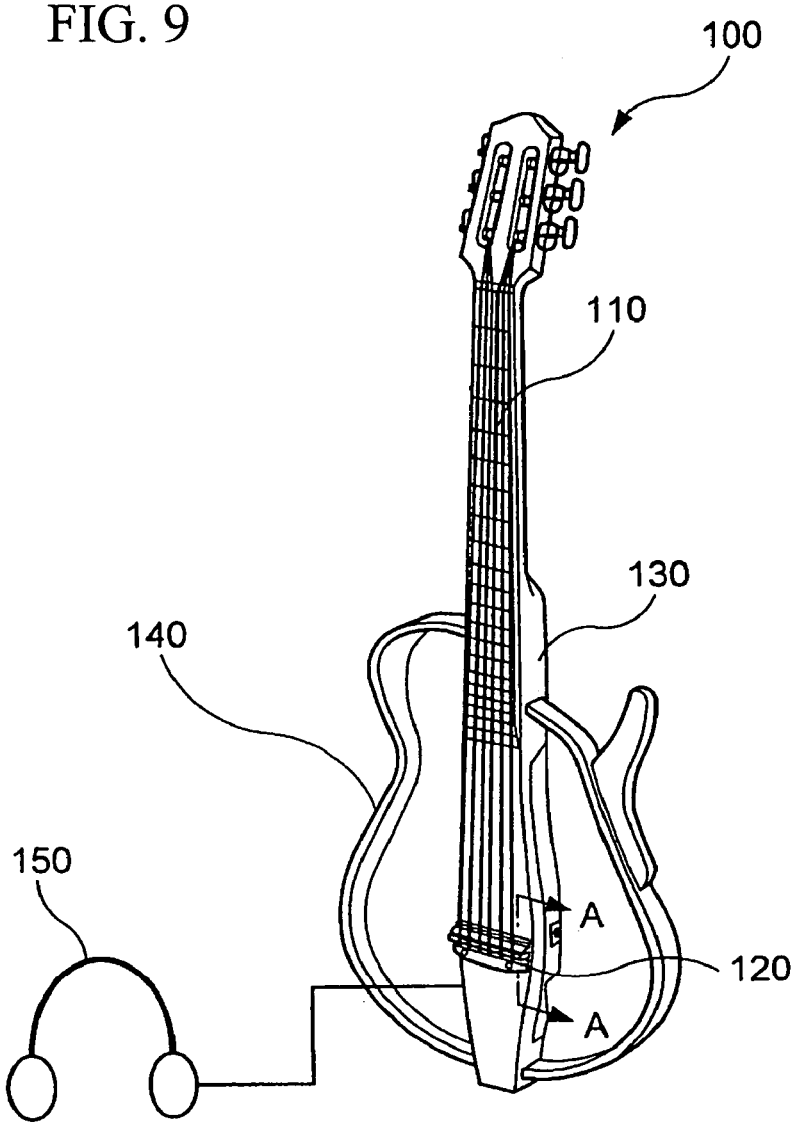
FIG. 9 is a perspective view showing the exterior appearance of a conventionally-known sound mute guitar.
Figure 10:
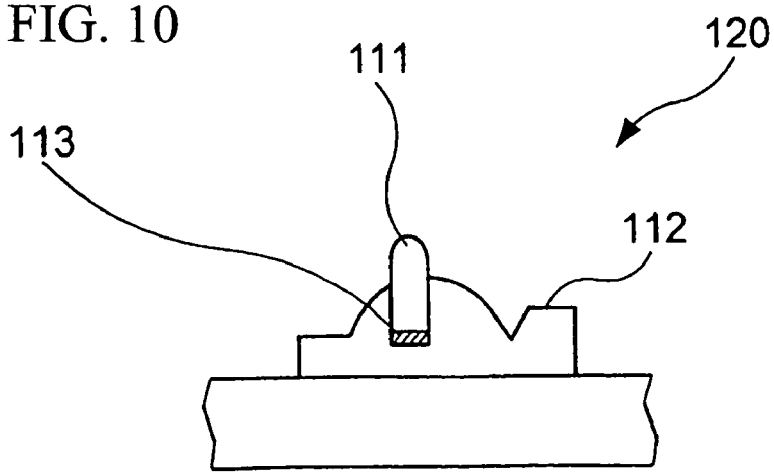
FIG. 10 is a cross sectional view taken along line A—A in FIG. 9 in proximity to a bridge of the sound mute guitar.
Figure 11:
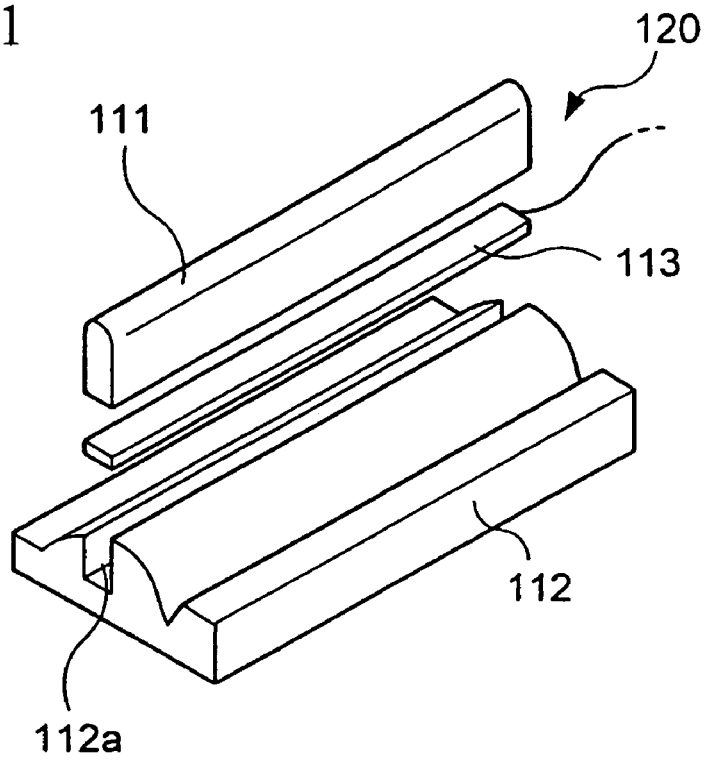
FIG. 11 is an exploded perspective view showing parts of the bridge incorporating a piezoelectric transducer.
Figure 12:
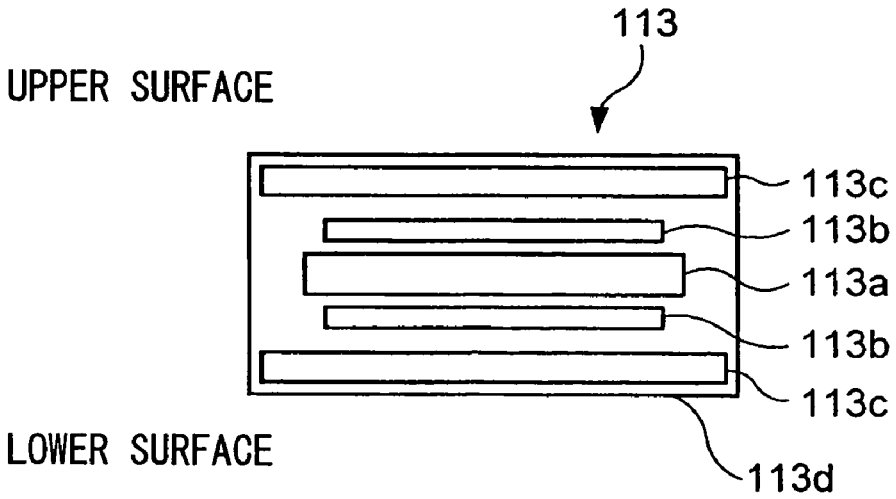
FIG. 12 diagrammatically shows a cross-sectional constitution of the piezoelectric transducer.

FIG. 1 diagrammatically shows a cross-sectional constitution of a piezoelectric transducer 213 that is installed in a sound mute guitar in accordance with a preferred embodiment of the invention, and FIG. 1 can be compared with FIG. 12 diagrammatically showing the cross-sectional constitution of the piezoelectric transducer 113 conventionally adapted to the bridge 120 of the sound mute guitar 100 shown in FIG. 9. Herein, the present embodiment is designed for a sound mute guitar that is basically identical to the aforementioned sound mute guitar 100 except that the nylon strings 110 are replaced with steel strings (not shown), and the sound mute guitar has a bridge basically identical to the aforementioned bridge 120 shown in FIG. 10; hence, a detailed description and illustration thereof will be omitted.

Similar to the aforementioned piezoelectric transducer 113, the piezoelectric transducer 213 of the present embodiment is constituted by a polymeric piezoelectric film 113*a*, a pair of electrodes 113*b*, a pair of insulation sheets 113*c* that are arranged to cover the electrodes 113*b*, and a conductive shield 113*d* that is arranged to cover the insulation sheets 113*c*. The present embodiment is characterized in that a thin metal plate 213*e* whose thickness is approximately set to 40 μm is adhered (or bonded) onto the exterior of the upper surface of the conductive shield 113*d*. The thin metal plate 213*e* is composed of a prescribed metal selected from among copper, gold, and platinum or a prescribed alloy mainly composed of one of these metals. In addition, the thin metal plate 213*e* is adhered to the conductive shield 113*d* by use of a prescribed adhesive (or a prescribed bonding agent). The present embodiment is designed under the assumption that the thickness of the insulation sheet 113*c* may range from 0.1 mm to 0.3 mm, for example. Of course, it is preferable that the thickness of the insulation sheet 113*c* be reduced so as to be as small as possible.

The adhesive used in the present embodiment has unhardening characteristic such that it does not harden after adhesion. Therefore, the adhesive used in the present embodiment differs from the conventional adhesive that hardens after adhesion. The reason why the prescribed adhesive is used to adhere the thin metal plate 213*e* to the conductive shield 113*d* is so that the transmission of string vibrations via the support member 111 is not necessarily blocked. As the prescribed adhesive used for adhesion between the thin metal plate 213*e* and the conductive shield 113*d*, it is possible to use an acrylic agent, a polyester agent, or a silicon agent, for example. In addition, the coating thickness of the prescribed adhesive must be reduced to be as small as possible, and it is preferable that the coating thickness is set to 10 μm or less. Incidentally, a similar adhesive can be adapted for adhesion between the electrode 113*b* and the insulation sheet 113*c* and for adhesion between the insulation sheet 113*c* and the conductive shield 113*d*, and it is preferable that the coating thickness therefor be set to 10 μm or less.

Next, experimental results regarding the piezoelectric transducer 213 described above will be described while discussing influences of the provision of the thin metal plate 213*e* exerted on the tone color of the sound mute guitar and influences of the coating thickness of the prescribed adhesive exerted on the tone color of the sound mute guitar.

Figure 2:
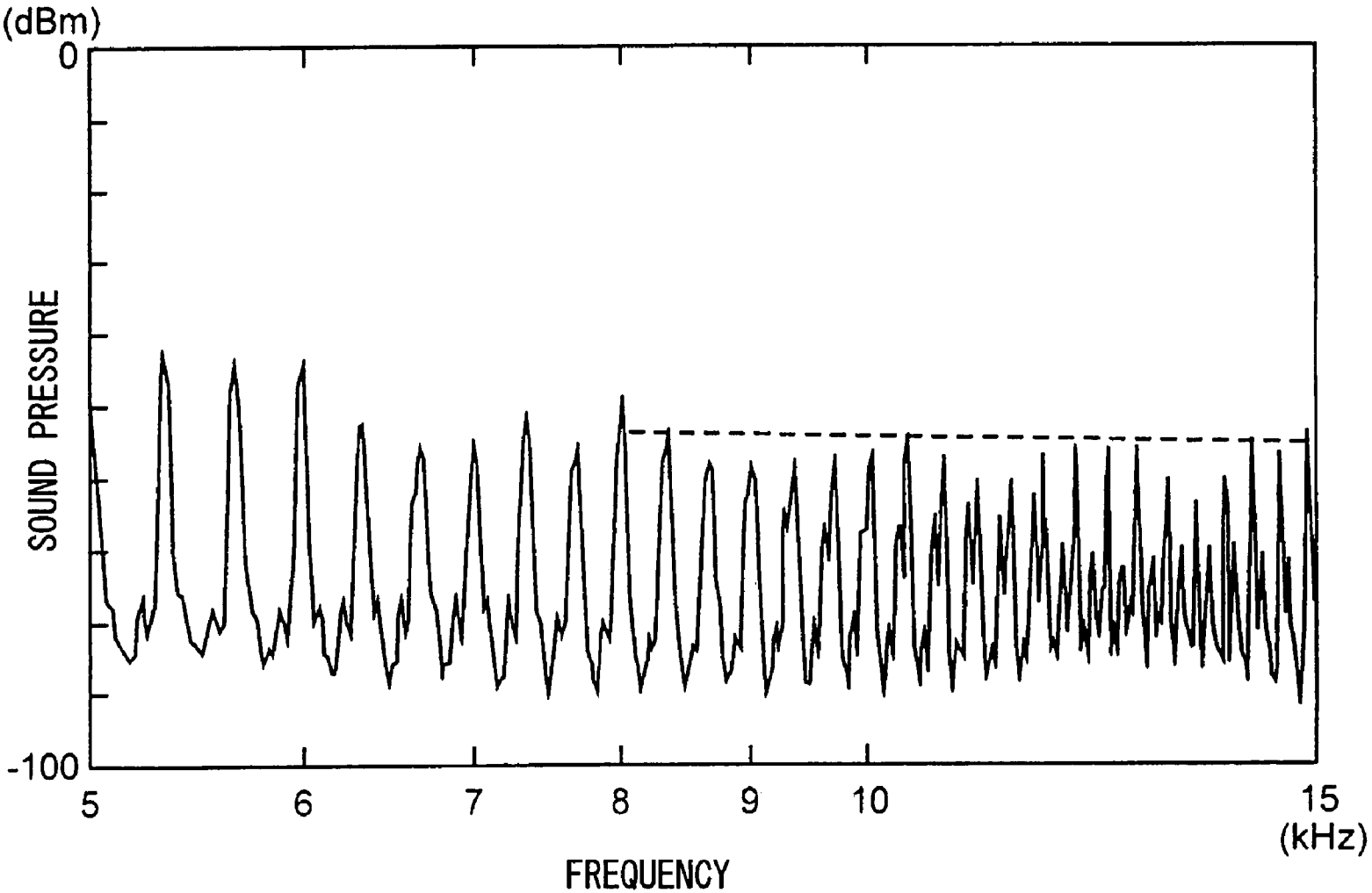
FIG. 2 is a graph showing measurement results regarding sound pressure levels in a frequency range between 5 kHz and 15 kHz with respect to a sound mute guitar equipped with a piezoelectric transducer having a thin metal plate adhered to the exterior of the upper surface of a conductive shield.
Figure 3:
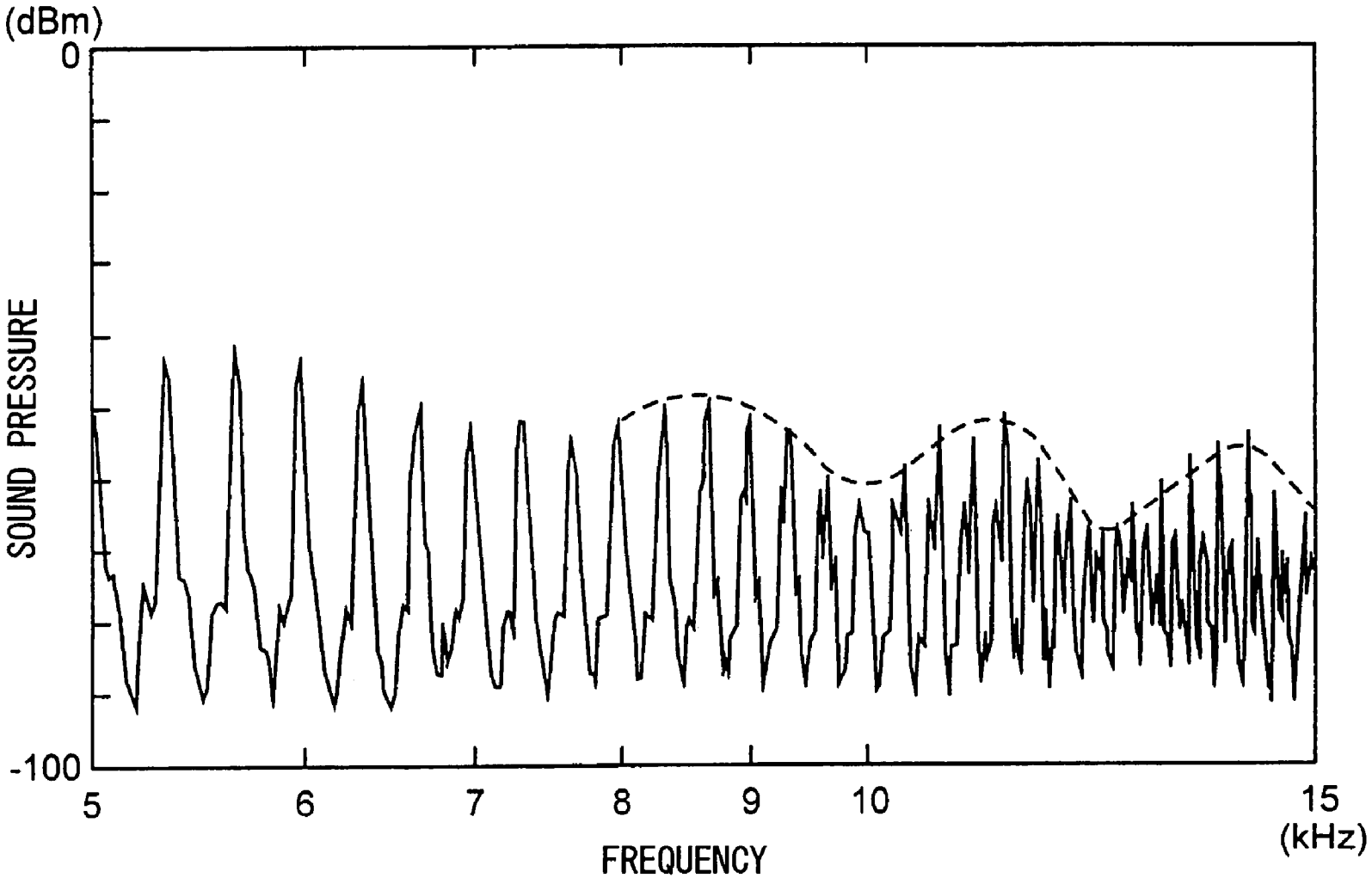
FIG. 3 is a graph showing measurement results regarding sound pressure levels in a frequency range between 5 kHz and 15 kHz with respect to a sound mute guitar equipped with a piezoelectric transducer not having a thin metal plate.

(a) Influences of the Thin Metal Plate 213*e* Exerted on the Tone Color of the Sound Mute Guitar FIGS. 2 and 3 show measurement results regarding sound pressure levels that are measured in a prescribed frequency range between 5 kHz and 15 kHz when plucking an open string of a sound mute guitar. Specifically, FIG. 2 shows the measurement results obtained upon measurement of a sound mute guitar having a piezoelectric transducer in which the aforementioned thin metal plate 213*e* is adhered to the exterior of the upper surface of the conductive shield 113*d*; and FIG. 3 shows the measurement results obtained upon measurement of a sound mute guitar having a piezoelectric transducer in which the thin metal plate 213*e* is not adhered to the exterior of the upper surface of the conductive shield 113*d*. The aforementioned measurements are performed using the sound mute guitar in which steel strings are stretched under tension over the neck (or finger board), and plucking is performed on a first string (namely, one of the open strings normally arranged close to a player (or a guitarist)). In addition, the thin metal plate 213*e* is composed of copper for the experiments.

FIG. 3 shows that when the thin metal plate 213*e* is not adhered to the exterior of the upper surface of the conductive shield 113*d*, sound pressure levels greatly fluctuate (or vary) in accordance with a certain waveform, particularly in a higher frequency range between 9 kHz and 15 kHz. In contrast, FIG. 2 shows that when the thin-metal plate 213*e* is adhered to the exterior of the upper surface of the conductive shield 113*d*, sound pressure levels are substantially maintained constant in a higher frequency range between 9 kHz and 15 kHz. In summary, it can be said that by adhering the thin metal plate 213*e* to the exterior of the upper surface of the conductive shield 113*d*, preferred characteristics can be obtained with respect to pitches in a certain frequency range (see the troughs in the fluctuations of sound pressure levels), and the sound mute guitar whose piezoelectric transducer does not have the thin metal plate 213*e* cannot realize preferred characteristics. This is very effective because general users (or players) of guitars normally regard tone colors in such a higher frequency range between 5 kHz and 15 kHz as important factors in playing guitars.

Figure 4:
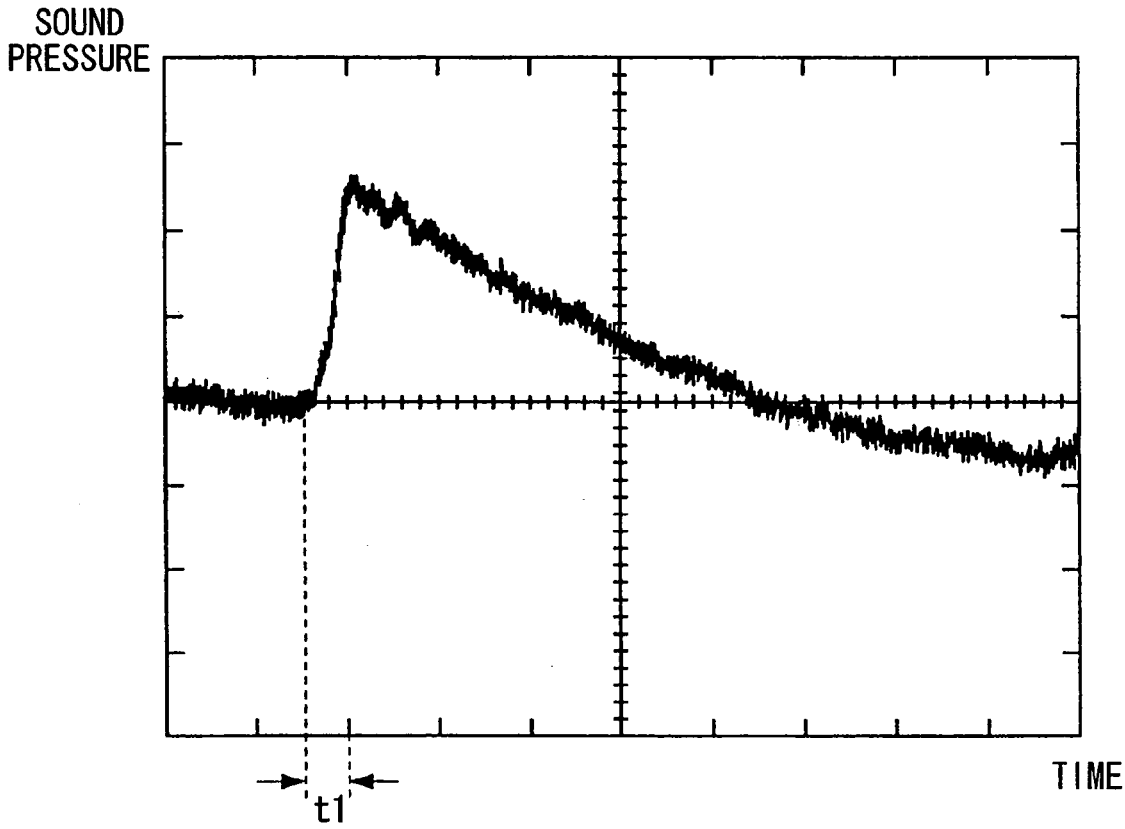
FIG. 4 is a graph showing an attack portion of a sound pressure waveform resulting from measurement on a sound mute guitar equipped with a piezoelectric transducer in which a thin metal plate is adhered to a conductive shield by use of a prescribed adhesive of a relatively small coating thickness.
Figure 5:
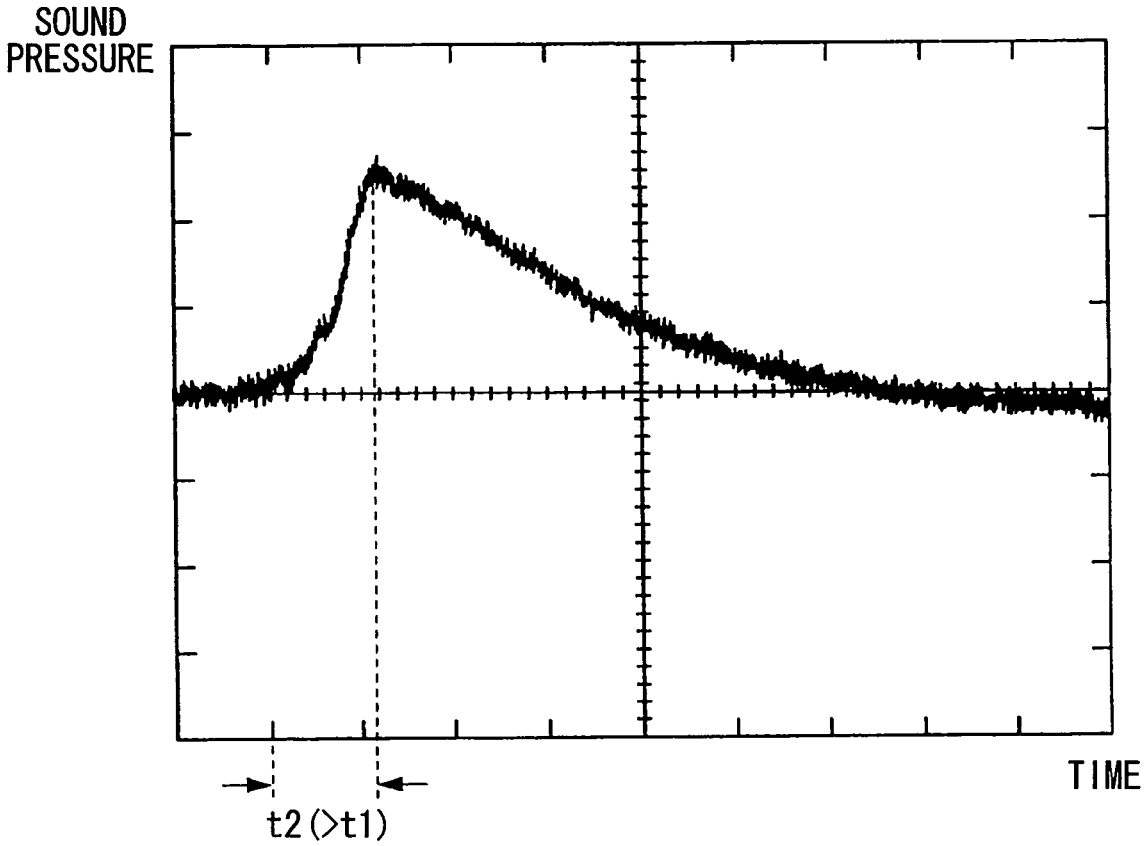
FIG. 5 is a graph showing an attack portion of a sound pressure waveform resulting from measurement on a sound mute guitar equipped with a piezoelectric transducer in which a thin metal plate is adhered to a conductive shield by use of a prescribed adhesive of a relatively large coating thickness.

(b) Influences of the Coating Thickness of the Prescribed Adhesive Exerted on the Tone Color of the Sound Mute Guitar FIGS. 4 and 5 show initial portions (or attack portions) of sound pressure waveforms, each of which is measured by plucking an open string (i.e., a first string) of a sound mute guitar equipped with the piezoelectric transducer 213 in which the thin metal plate 213*e* is adhered to the exterior of the upper surface of the conductive shield 113*d* by use of the prescribed adhesive. Specifically, the graph of FIG. 4 results from measurement upon measurement with regard to a relatively small coating thickness of the prescribed adhesive (approximately 10 μm), and the graph of FIG. 5 results from measurement with regard to a relatively large coating thickness of the prescribed adhesive (approximately ranging from 50 μm to 60 μm).

The sound pressure waveform of FIG. 4 has rise time t1 in which the level (or magnitude) thereof is rapidly increased from the bottom to the peak, and the sound pressure waveform of FIG. 5 has a rise time t2 in which the level thereof is rapidly increased from the bottom to the peak. It is obvious from the graphs of FIGS. 4 and 5 upon comparison between the rise times t1 and t2 that the sound pressure level increases sharply in FIG. 4 (regarding the relatively small coating thickness of the prescribed adhesive) compared with FIG. 5 (regarding the relatively large coating thickness of the prescribed adhesive). As the sound pressure level increases sharply, the time required for discriminating the sound becomes shorter. Thus, it is possible to produce musical tones having well-modulated properties (or clearness) simulating the actual sounds of acoustic guitars. Through the aforementioned experiments, it is proved that a good rise characteristic of the sound pressure level can be obtained as the coating thickness of the prescribed adhesive, which is used to adhere the thin metal plate 213*e* to the exterior of the upper surface of the conductive shield 113*d*, becomes smaller. Generally speaking, users (or players) of guitars may regard rise characteristics of sound pressure levels as important factors in playing guitars.

As described above, the present embodiment can noticeably improve the tone color of the sound mute guitar particularly in the higher frequency range by adhering the thin metal plate 213*e* to the exterior of the upper surface of the conductive shield 113*d*, which is one of the parts forming the piezoelectric transducer 213. In other words, the present embodiment can reliably improve piezoelectric transducers in its characteristics, particularly in higher frequency ranges, even when these piezoelectric transducers have inferior characteristics but yield high productivity and are produced at relatively low cost, by simply adhering a thin metal plate to the exterior of the upper surface of a conductive shield constituting each of the piezoelectric transducers, wherein the thin metal plate is composed of copper, gold, or platinum, or an alloy mainly composed of one of these metals.

In addition, the present embodiment can improve a shielding effect against hum noise (or humming noise) because the thin metal plate 213*e* is adhered to the exterior of the upper surface of the conductive shield 113*d*. When the thin metal plate 231*e* is not adhered to the exterior of the upper surface of the conductive shield 113*d*, hum noise is shielded by the conductive shield 113*d* only, and the conductive shield 113*d* may not necessarily guarantee uniform distribution of potentials so that the shield effect may be weakened. In contrast, when the thin metal plate 213*e* is adhered to the exterior of the upper surface of the conductive shield 113*d*, it is possible to shield hum noise by both the thin metal plate 213*e* and the conductive shield 113*d*; therefore, it is possible to noticeably improve the shielding effect.

Furthermore, the present embodiment limits the coating thickness of the prescribed adhesive, which is used to adhere the thin metal plate 213*e* to the exterior of the upper surface of the conductive shield 113*d*, to approximately 10 μm or so. Therefore, it is possible to noticeably improve the rise characteristics of sound pressure levels in the present embodiment compared with the foregoing piezoelectric transducer in which the coating thickness of the prescribed adhesive is increased in an approximate range from 50 μm to 60 μm.

It is possible to modify the present embodiment in various manners; therefore, modified examples will be described with reference to FIGS. 6 to 8.

Figure 6:
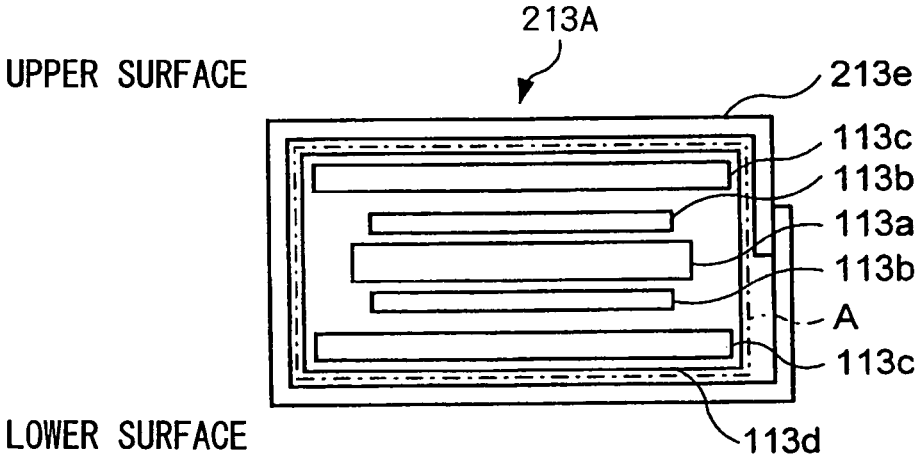
FIG. 6 is a cross sectional view diagrammatically showing a cross-sectional constitution of a piezoelectric transducer of a modified example.
Figure 7:
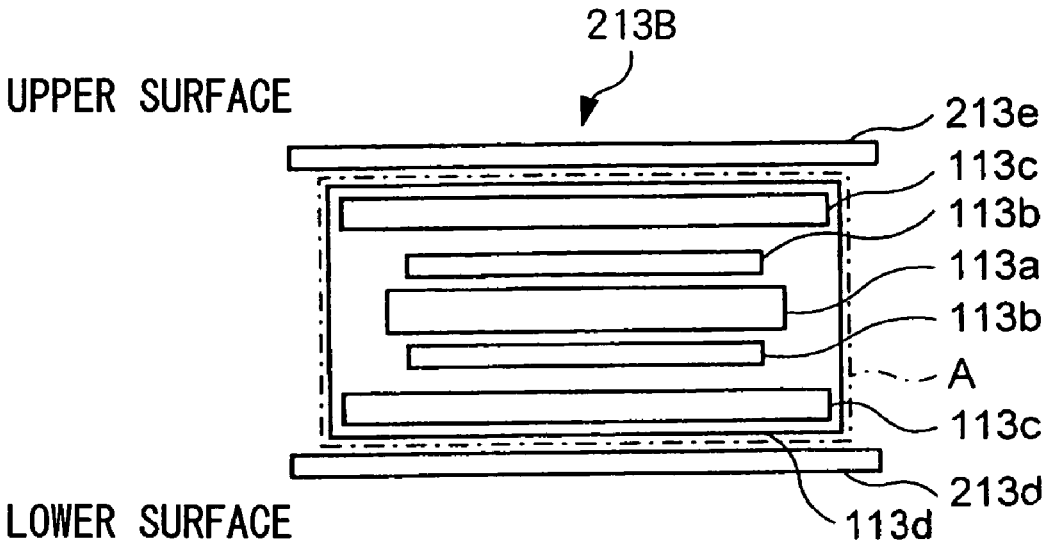
FIG. 7 is a cross sectional view diagrammatically showing a cross-sectional constitution of a piezoelectric transducer of a modified example.
Figure 8:
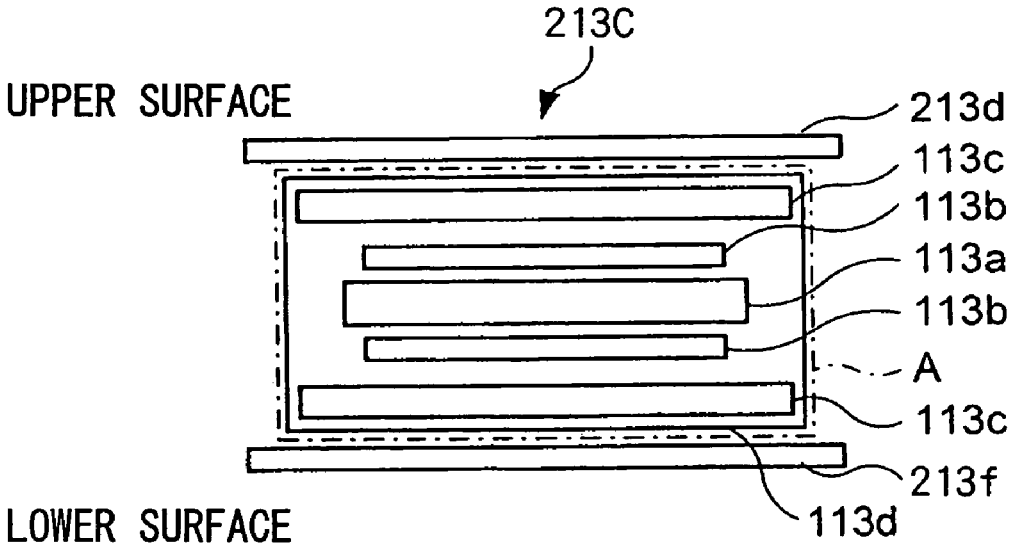
FIG. 8 is a cross sectional view diagrammatically showing a cross-sectional constitution of a piezoelectric transducer of a modified example.

FIGS. 6 to 8 show cross-sectional constitutions of piezoelectric transducers 213A–213C.

In the present embodiment, the thin metal plate 213*e* composed of copper is adhered to the exterior of the upper surface of the conductive shield 113*d*. It is possible to modify the present embodiment in such a way that, as shown in FIG. 6, a thin metal plate 213*e* composed of copper is adhered to completely cover (or encapsulate) a piezoelectric transducer section 'A', which is constituted by a polymeric piezoelectric film 113*a*, a pair of electrodes 113*b*, and a pair of insulation sheets 113*c*, all of which are covered with a conductive shield 113*d*. Alternatively, as shown in FIG. 7, a thin metal plate 213*e* composed of copper is adhered to the exterior of the upper surface of the piezoelectric transducer section A, and another thin metal plate 213*d* composed of copper is adhered to the exterior of the lower surface of the piezoelectric transducer section A. As show in FIG. 8, a thin metal plate 213*e* composed of copper is adhered to the exterior of the upper surface of the piezoelectric transducer section A, and another thin metal plate 213*f* composed of gold or platinum is adhered to the exterior of the lower surface of the piezoelectric transducer section A. In summary, this invention requires a piezoelectric transducer to incorporate at least one thin metal plate 213*e*, which is composed of copper, gold, or platinum, or an alloy mainly composed of one of these metals, to be adhered to the exterior of the upper surface of the conductive shield 113*d*. Hence, it may be possible for a manufacturer to determine whether or not another thin metal plate should be adhered to the other surface of the conductive shield 113*d* in accordance with the design (or specification) of the piezoelectric transducer to be produced.

The present embodiment is designed for a sound mute guitar in which steel strings are stretched over a neck under tension. Of course, this invention can be adapted to a sound mute guitar in which nylon strings are stretched over a neck under tension. In addition, this invention is not necessarily adapted to sound mute guitars; therefore, it is possible to apply this invention to other types of 'sound mute' stringed instruments such as sound mute violins. In short, this invention can be adapted to any type of stringed instrument equipped with a piezoelectric transducer for producing electric signals upon detection of vibrations of strings.

As described heretofore, this invention has a variety of effects and technical features, which will be described below.

(1) A piezoelectric transducer of this invention is adapted to a bridge of a stringed instrument such as a sound mute guitar to produce electric signals upon detection of vibrations of strings, and the characteristics can be improved even though the instrument is produced at a high productivity and at a relatively low cost.

(2) Specifically, a piezoelectric transducer is constituted by a piezoelectric element (e.g., a polymeric piezoelectric film) having a roughly elongated rectangular shape, a pair of electrodes respectively adhered to the upper and lower surfaces of the piezoelectric element, and insulation members (or insulation sheets), all of which are covered with a shield layer (e.g., a conductive shield), wherein at least a thin metal plate, which is composed of copper, gold, or platinum, or an alloy mainly composed of one of these metals, is adhered to the exterior of the upper surface of the shield layer.

(3) Due to the adhesion of the aforementioned thin metal plate onto the exterior of the upper surface of the shield layer of the piezoelectric transducer, it is possible to noticeably improve the tone color of a stringed instrument particularly in a higher frequency range; this is certainly proved through experiments (see FIGS. 2 and 3). In other words, it is possible to reliably improve characteristics of the piezoelectric transducer, which can be produced at a high productivity and at a relatively low cost, by simply adhering a thin metal plate, which is composed of copper, gold, or platinum, or an alloy mainly composed of one of these metals, to the exterior of the upper surface of the shield layer covering the piezoelectric transducer. This contributes to a noticeable improvement in the tone color of a stringed instrument particularly in a higher frequency range.

(4) Due to the adhesion of the thin metal plate onto the exterior of the upper surface of the shield layer of the piezoelectric transducer, it is possible to noticeably improve a shielding effect against hum noise. That is, when the thin metal plate is not adhered to the shield layer of the piezoelectric transducer, hum noise must be shielded by the shield layer only, whereas when the thin metal plate is adhered to the shield layer of the piezoelectric transducer, it is possible to shield hum noise by both the thin metal plate and the shield layer; this contributes to a further improvement of the shielding effect against hum noise.

(5) Incidentally, it is possible to modify the piezoelectric transducer in such a way that a thin metal plate composed of copper is adhered to the exterior of the upper surface of the shield layer, and another thin metal plate composed of gold or platinum is adhered to the exterior of the lower surface of the shield layer.

As this invention may be embodied in several forms without departing from the spirit or essential characteristics thereof, the present embodiment and its modifications are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A piezoelectric transducer for producing electric signals upon detection of vibrations of strings of a stringed instrument, comprising:

a piezoelectric element roughly having an elongated rectangular shape;

a pair of electrodes that are respectively attached to an upper surface and a lower surface of the piezoelectric element;

a pair of insulation members for insulating the pair of electrodes respectively;

a shield layer that is arranged to cover the piezoelectric element, the pair of electrodes, and the pair of insulation members; and a thin metal plate that is adhered to at least an exterior of an upper surface of the shield layer and that is composed of a prescribed metal, which is selected from among copper, gold, and platinum, or a prescribed alloy mainly composed of one of copper, gold, and platinum.

2. A piezoelectric transducer according to claim 1, wherein the thin metal plate is adhered to the shield layer by use of un-hardened adhesive with a coating thickness of 10 μm or less.

3. A piezoelectric transducer according to claim 1, wherein the thin metal plate is composed of copper and is adhered to the exterior of the upper surface of the shield layer, and a secondary thin metal plate composed of gold or platinum is adhered to an exterior of a lower surface of the shield layer.

4. A bridge for a stringed instrument equipped with a piezoelectric transducer for producing electric signals upon detection of vibrations of strings, said bridge comprising:

a support member for supporting strings of the stringed instrument; and a bridge base for vertically supporting the support member, wherein said piezoelectric transducer comprises a piezoelectric element roughly having an elongated rectangular shape, a pair of electrodes that are respectively attached to an upper surface and a lower surface of the piezoelectric element, a pair of insulation members for insulating the pair of electrodes respectively, a shield layer that is arranged to cover the piezoelectric element, the pair of electrodes, and the pair of insulation members, and a thin metal plate that is adhered to at least an exterior of an upper surface of the shield layer and that is composed of a prescribed metal, which is selected from among copper, gold, and platinum, or a prescribed alloy mainly composed of one of copper, gold, and platinum.

5. The bridge for a stringed instrument according to claim 4, wherein the bridge base has an elongated hollow into which the support member is partially inserted via the piezoelectric transducer.

6. A stringed instrument equipped with a piezoelectric transducer adapted to a bridge, said piezoelectric transducer comprising:

a piezoelectric element roughly having a roughly elongated rectangular shape, a pair of electrodes that are respectively attached to an upper surface and a lower surface of the piezoelectric element, a pair of insulation members for insulating the pair of electrodes respectively, a shield layer that is arranged to cover the piezoelectric element, the pair of electrodes, and the pair of insulation members, and a thin metal plate that is adhered to at least an exterior of an upper surface of the shield layer and that is composed of a prescribed metal, which is selected from among copper, gold, and platinum, or a prescribed alloy mainly composed of one of copper, gold, and platinum.

7. The stringed instrument according to claim 6, wherein the bridge comprises:

a support member for supporting strings; and a bridge base having an elongated hollow for vertically supporting the support member via the piezoelectric transducer.

* * * * *